US012344500B2

(12) United States Patent
Matsuda et al.

(10) Patent No.: US 12,344,500 B2
(45) Date of Patent: Jul. 1, 2025

(54) PAPER FEEDING ROLLER AND PAPER FEEDING DEVICE

(71) Applicant: Sumitomo Riko Company Limited, Aichi (JP)

(72) Inventors: Hirotoshi Matsuda, Aichi (JP); Kazushi Yamaguchi, Aichi (JP); Wataru Imamura, Aichi (JP)

(73) Assignee: Sumitomo Riko Company Limited, Aichi (JP)

( * ) Notice: Subject to any disclaimer, the term of this patent is extended or adjusted under 35 U.S.C. 154(b) by 50 days.

(21) Appl. No.: 18/297,652

(22) Filed: Apr. 10, 2023

(65) Prior Publication Data

US 2023/0264907 A1 Aug. 24, 2023

Related U.S. Application Data

(63) Continuation of application No. PCT/JP2021/039797, filed on Oct. 28, 2021.

(30) Foreign Application Priority Data

Oct. 30, 2020 (JP) ..... 2020-182185

(51) Int. Cl.
*B65H 3/52* (2006.01)
*B65H 3/06* (2006.01)
(Continued)

(52) U.S. Cl.
CPC ..... *B65H 5/062* (2013.01); *B65H 3/0653* (2013.01); *B65H 3/54* (2013.01); *B65H 27/00* (2013.01); *B65H 2801/06* (2013.01)

(58) Field of Classification Search
CPC ..... B65H 5/062; B65H 3/06; B65H 3/0638; B65H 3/0653; B65H 3/54;
(Continued)

(56) References Cited

U.S. PATENT DOCUMENTS 5,211,390 A * 5/1993 Igaki ..... B65H 9/166 271/251
5,460,457 A * 10/1995 Mindler ..... B41J 13/02 271/251
(Continued)

FOREIGN PATENT DOCUMENTS

JP S6374842 4/1988
JP H10212044 8/1998
(Continued)

OTHER PUBLICATIONS

"International Search Report (Form PCT/ISA/210) of PCT/JP2021/039797", mailed on Nov. 22, 2021, with English translation thereof, pp. 1-4.
(Continued)

*Primary Examiner* — Luis A Gonzalez
(74) *Attorney, Agent, or Firm* — JCIPRNET

(57) ABSTRACT

In the paper feeding roller, a shaft body has a cantilever structure supported at one end, and an elastic layer includes a supported end and a free end on both ends along a rotation axis, wherein an outer diameter of the free end in a cross section orthogonal to the rotational axis is greater than that of the supported end, and an area including the free end has a widened bottom part having an outer diameter which widens in a linear or inner convex manner approaching the free end along the rotation axis. The paper feeding device includes a feed roller rotationally driven and conveying paper, and a retard roller pressed against the feed roller, affixed with a torque limiter, and suppressing double feeding of paper. At least one of the feed roller and the retard roller is formed as the paper feeding roller.

12 Claims, 8 Drawing Sheets

1

(51) Int. Cl.
*B65H 3/54* (2006.01)
*B65H 5/06* (2006.01)
*B65H 27/00* (2006.01)

(58) Field of Classification Search
CPC .... B65H 2404/1312; B65H 2404/1314; B65H 2404/1317; B65H 2404/13171; B65H 2404/1315; B65H 27/00
See application file for complete search history.

(56) References Cited

U.S. PATENT DOCUMENTS 10,261,460 B2 4/2019 Konishi et al.
2008/0061495 A1* 3/2008 Shiraki ..... B65H 5/06 271/119
2015/0001786 A1* 1/2015 Kosuga ..... B65H 1/24 271/127
2023/0038655 A1* 2/2023 Shimosaka ..... B65H 5/06

FOREIGN PATENT DOCUMENTS

JP 2016204126 A * 12/2016
JP 2017065907 4/2017
WO WO-2021085365 A1 * 5/2021

OTHER PUBLICATIONS

"Written Opinion of the International Searching Authority (Form PCT/ISA/237) of PCT/JP2021/039797", mailed on Nov. 22, 2021, with English translation thereof, pp. 1-6.

* cited by examiner

| | Roller shape | Shape diagram | Surface pressure distribution | Durability |
|---|---|---|---|---|
| Example 20 | Widened bottom |  | A | A |
| Comparative Example 1 | Straight |  | D | D |
| Comparative Example 2 | Crown |  | E | E |
| Comparative Example 3 | Reverse crown |  | E | E |

| | Surface pressure distribution | Uniformity evaluation |
|---|---|---|
| (a) |   | A (Uniformity high) |
| (b) |   | D (Uniformity low) |

PAPER FEEDING ROLLER AND PAPER FEEDING DEVICE

CROSS-REFERENCE TO RELATED APPLICATION

The present application is a continuation of PCT/JP2021/039797, filed on Oct. 28, 2021, and is related to and claims priority from Japanese Patent Application No. 2020-182185, filed on Oct. 30, 2020. The entire contents of each of the aforementioned applications are hereby incorporated by reference herein.

BACKGROUND

Technical Field

The disclosure relates to a paper feeding roller suitable as a component forming a paper feeding device included in an image forming apparatus, such as a copier, a printer, a fax machine, etc., and the paper feeding device including the paper feeding roller.

Description of Related Art

In an electronic photographic image forming apparatus such as a copier, a printer, a fax machine, etc., a paper feeding roller is provided in a paper feeding device that supplies paper. In general, the paper feeding roller is formed in a cylindrical shape by using an elastic material, such as a rubber crosslinked material, and the circumferential surface thereof serves as a contact surface with the paper. When conveying paper, such type of paper feeding roller is often pressed against another component and rotated in a state of receiving a surface pressure (nip pressure). During repetitive conveyance of paper, wear tends to occur on the surface of the paper feeding roller.

For example, in an electronic photographic image forming apparatus, a paper feeding device which has a set of a feed roller (paper feeding roller) rotationally driven and a retard roller (separation roller) affixed with a torque limiter and pressed against the feed roller and is provided with a function of suppressing double feeding of paper is adopted. In such case, with the feed roller and the retard roller rotating in a state of pressing against each other, wear tends to occur on one or both of the surfaces of the rollers. When wear occurs on the surface of the paper feeding roller, the contact area of the outer circumferential surface with respect to paper is reduced, and the friction coefficient decreases. Even if the paper feeding roller has not been used for a long time, a paper conveyance failure may occur.

An attempt has been made to maintain a high friction coefficient for a long time by configuring an uneven pattern on the surface of the paper feeding roller as a means for suppressing a conveyance failure due to wear of the surface of the paper feeding roller. For example, in Patent Document 1, multiple strips and grooves parallel to the axial direction of the paper feeding roller are formed. In addition, as another means for suppressing conveyance failure, for example, Patent Document 2 devises a support structure of a roller shaft.

PRIOR ART DOCUMENTS

Patent Documents

[Patent Document 1]: Japanese Laid-open No. 2017-065907

[Patent Document 2]: Japanese Laid-open No. H10-212044

As disclosed in Patent Document 1, the solution of forming a predetermined uneven pattern on the surface of the paper feeding roller is effective in a certain extent in suppressing the decrease in the friction coefficient of the surface. However, assuming a case where the paper feeding roller is used in a condition under which the wear of the surface occurs easily, it is favorable to further effectively suppress the decrease in the friction coefficient. For example, in recent years, inexpensive paper with a lot of ash or low-quality paper containing a lot of filler materials are used widely. When such paper with a lot of ash or filler materials is used, paper dust and dirt are generated when the paper is supplied, and such paper dust and dirt, together with aliphatic components contained in the filler materials, may tend to be attached to the surface of the paper feeding roller. This leads to a decrease in the friction coefficient between the paper feeding roller and the paper, which easily leads to a paper conveyance failure.

The attachment of paper dust and dirt when low quality paper is used can be suppressed to a certain extent by forming an uneven pattern on the surface of the paper feeding roller. However, if the surface pressure does not act on the entire roller uniformly, the wear (uneven wear) may progress, and the uneven pattern may be worn out. In such case, the effect of the uneven shape against the attachment of paper dust and dirt deteriorates, and the friction coefficient of the surface inevitably decreases. As a result, a paper conveyance failure tends to occur.

As disclosed in Patent Document 2, in the case where the paper feeding roller is arranged as a cantilever support structure, due to the load during paper conveyance, the paper feeding roller tends to bend. Therefore, the circumferential surface of the paper feeding roller is not in uniform contact with respect to the paper, and an axial end side of the roller circumferential surface is worn first, which leads to uneven wear. Accordingly, in the paper feeding roller that is cantilever-supported, in particular, a decrease in surface friction coefficient due to uneven wear tends to occur. As a result, even though the service time is not long, a paper conveyance failure still tends to occur.

SUMMARY

An aspect of the disclosure provides a paper feeding roller. The paper feeding roller includes: a shaft body; and an elastic body layer formed on an outer circumference of the shaft body. The paper feeding roller is comprised in a paper feeding device and is a paper feeding roller rotating with a rotation axis as a center. The paper feeding roller has a cantilever support structure in which the shaft body is supported at an end by the paper feeding device. The elastic body layer comprises, at two ends along the rotation axis, a supported end as an end at which the shaft body is supported by the paper feeding device, and a free end as an end at which the shaft body is not supported by the paper feeding device. In the elastic body layer, an outer diameter of a cross section orthogonal to the rotation axis is greater at the free end than at the supported end. A widened bottom part in which an outer diameter expands linearly or in an inwardly convex manner along the rotation axis toward the free end is provided in a region comprising the free end.

Figure 1:
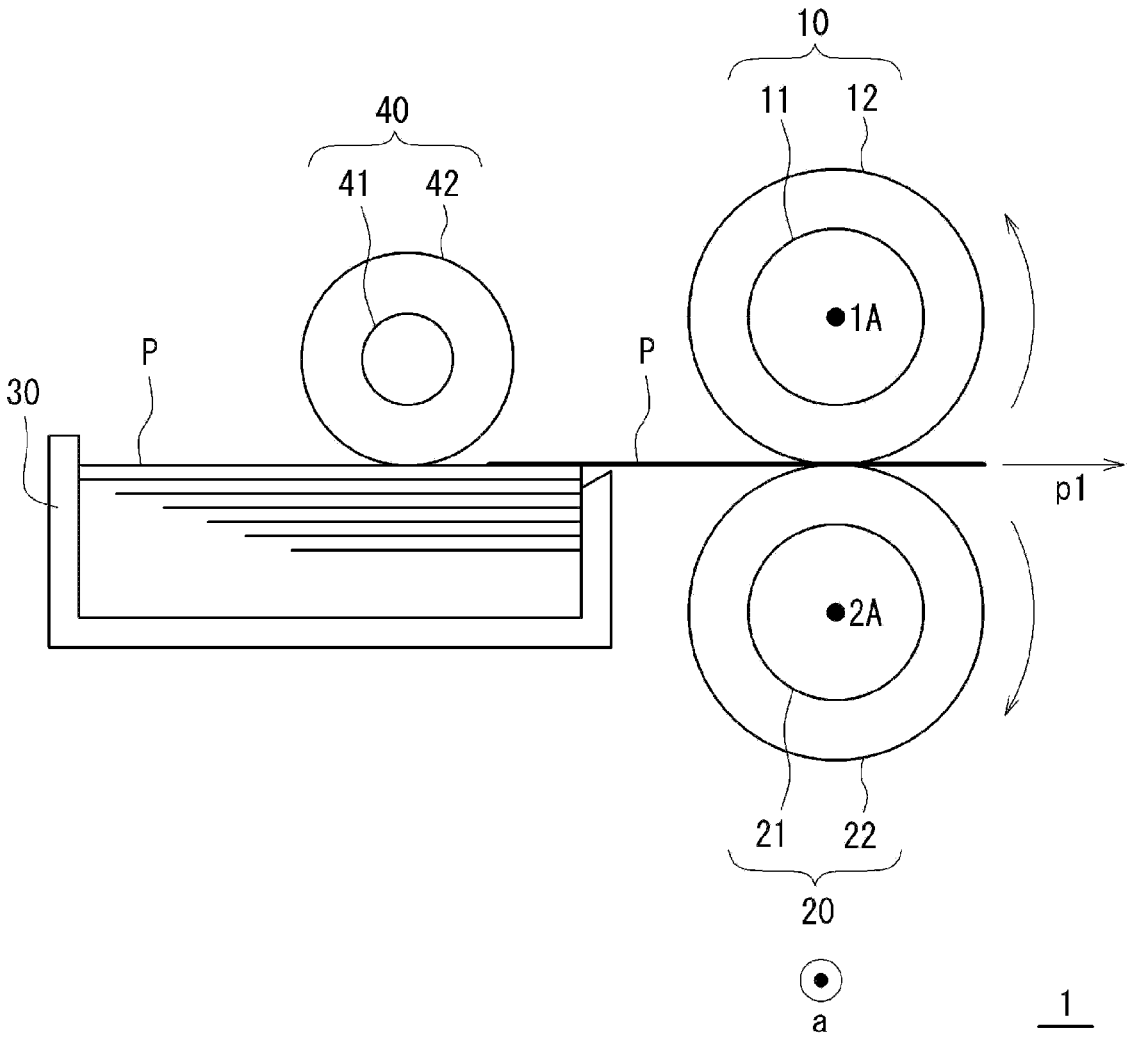
FIG. 1 is a schematic view illustrating a paper feeding device according to an embodiment of the disclosure. A state viewed from a free end side of a feed roller and a retard roller is shown.
Figure 3:
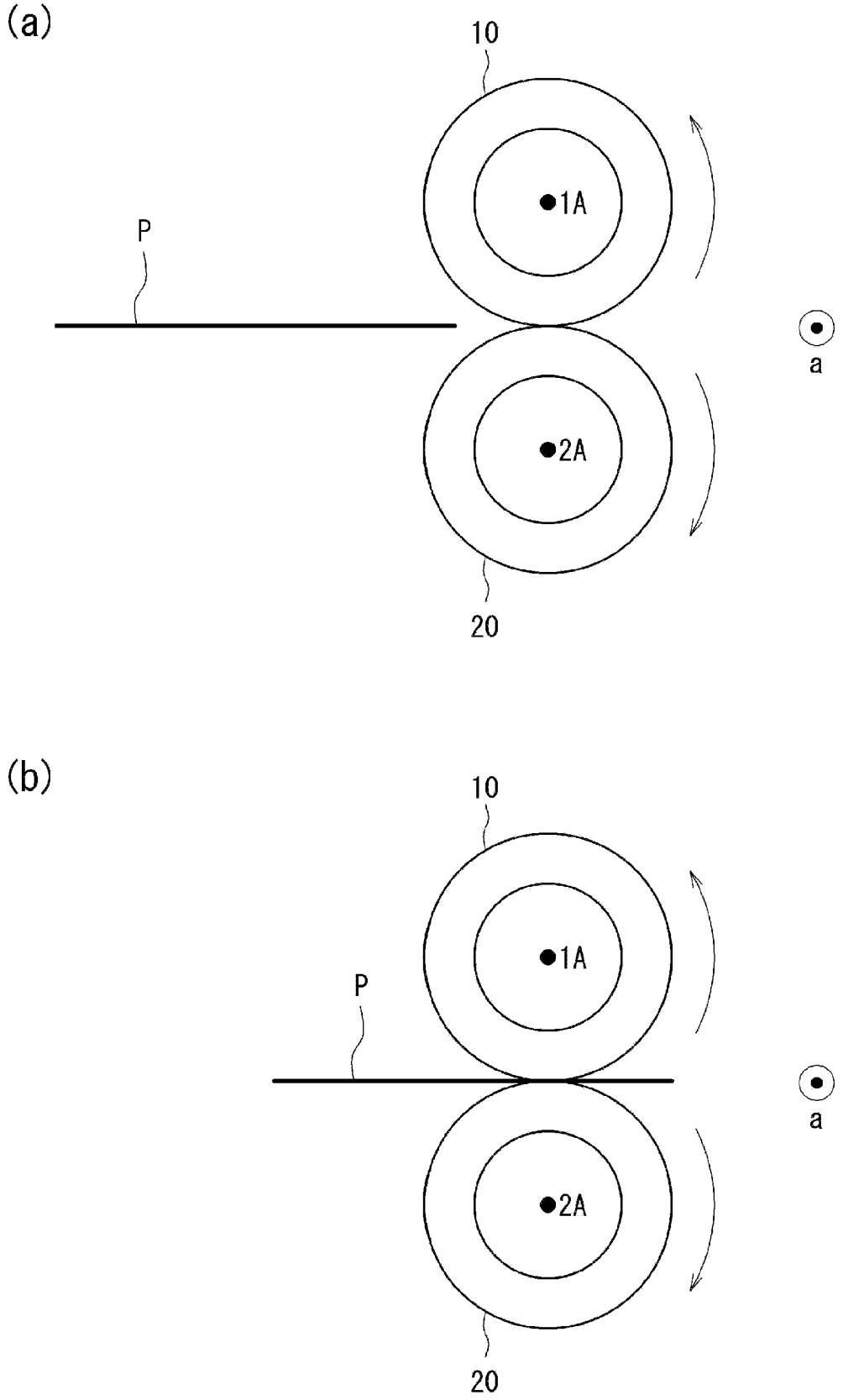

(a) and (b) of FIG. 3 are views illustrating a paper feeding operation of the paper feeding device shown in FIG. 1. (a) of FIG. 3 illustrates a state before one sheet of paper arrives between the rollers, and (b) of FIG. 3 illustrates an operation when the one sheet of paper arrives between the rollers.

Figure 4:
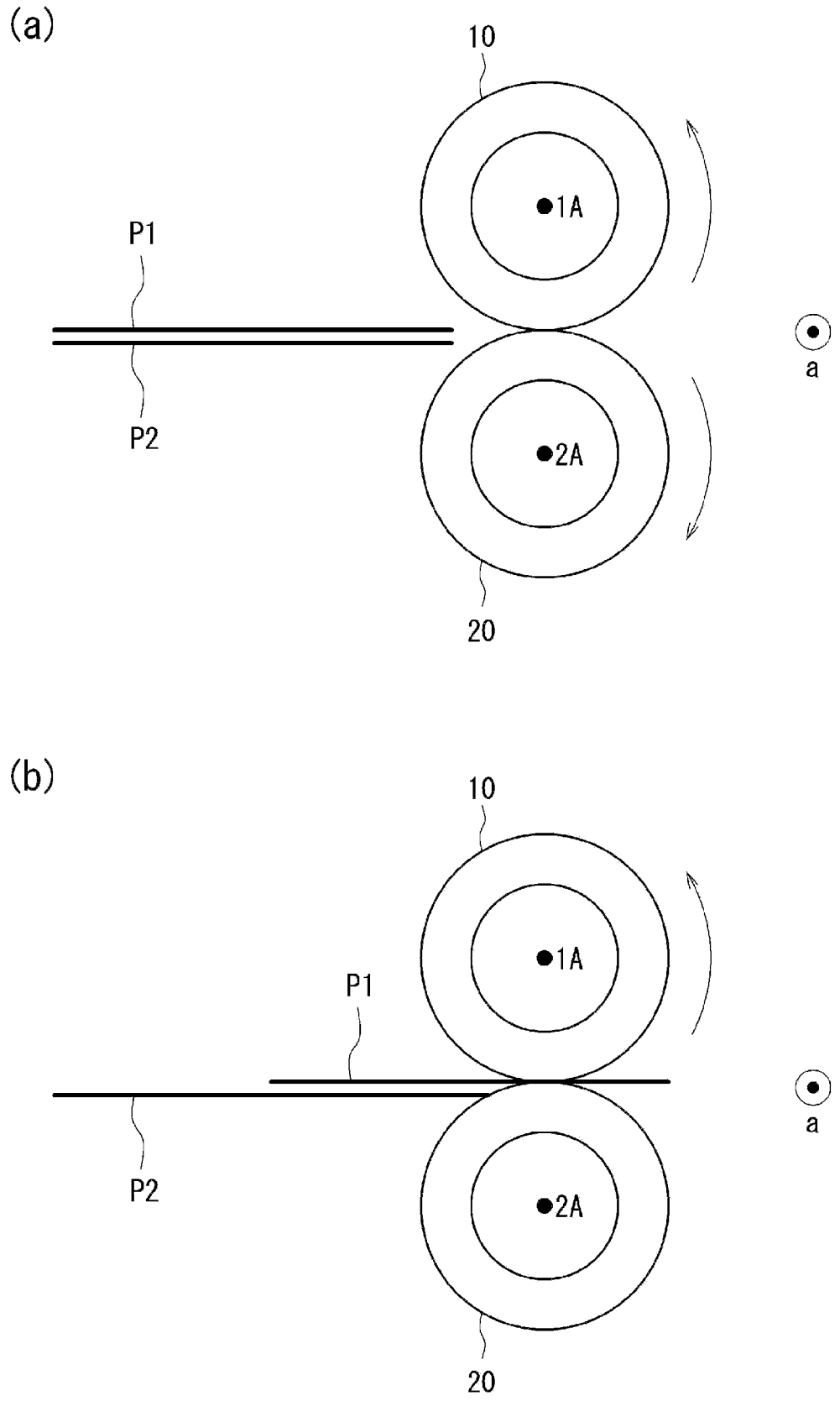

(a) and (b) of FIG. 4 are views illustrating a paper feeding operation of the paper feeding device shown in FIG. 1. (a) of FIG. 4 illustrates a state before two sheets of paper arrive between the rollers, and (b) of FIG. 4 illustrates an operation when the two sheets of paper arrive between the rollers.

Figure 5:
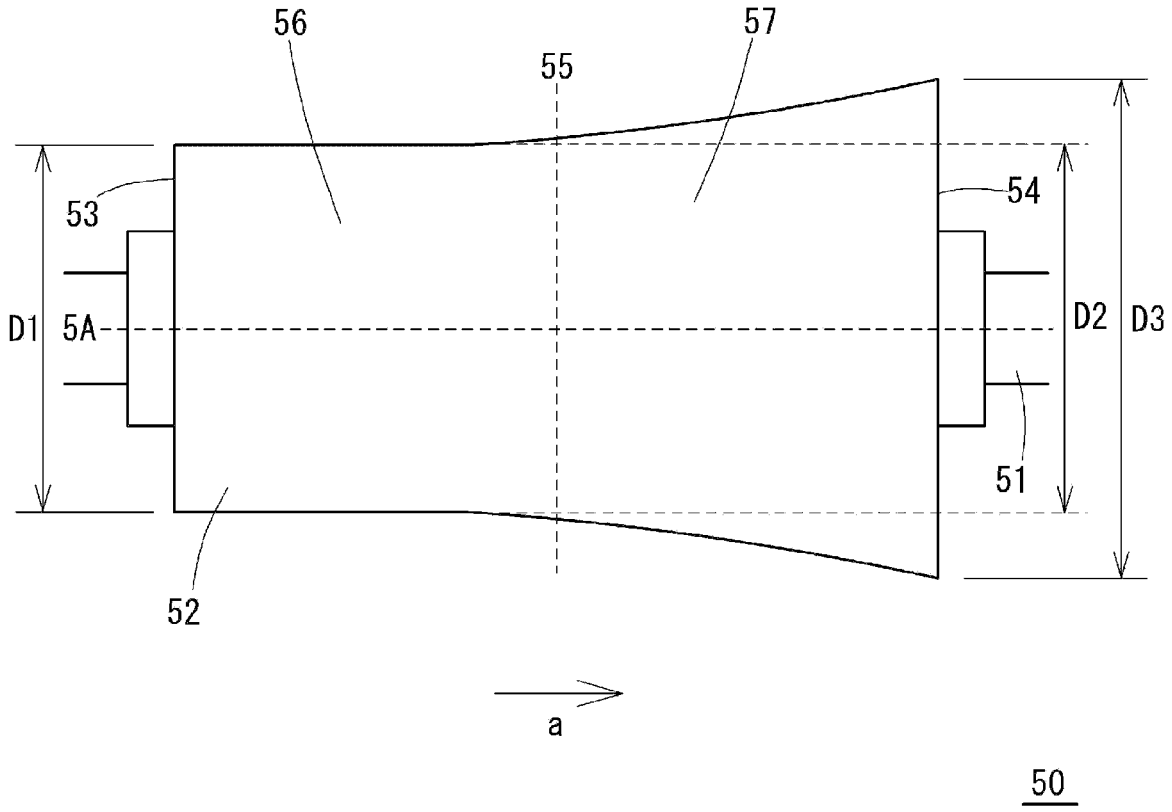

FIG. 5 is a schematic view illustrating a shape of a paper feeding roller according to an embodiment of the disclosure. A state viewed from the front surface of the circumferential surface is shown.

Figure 6:
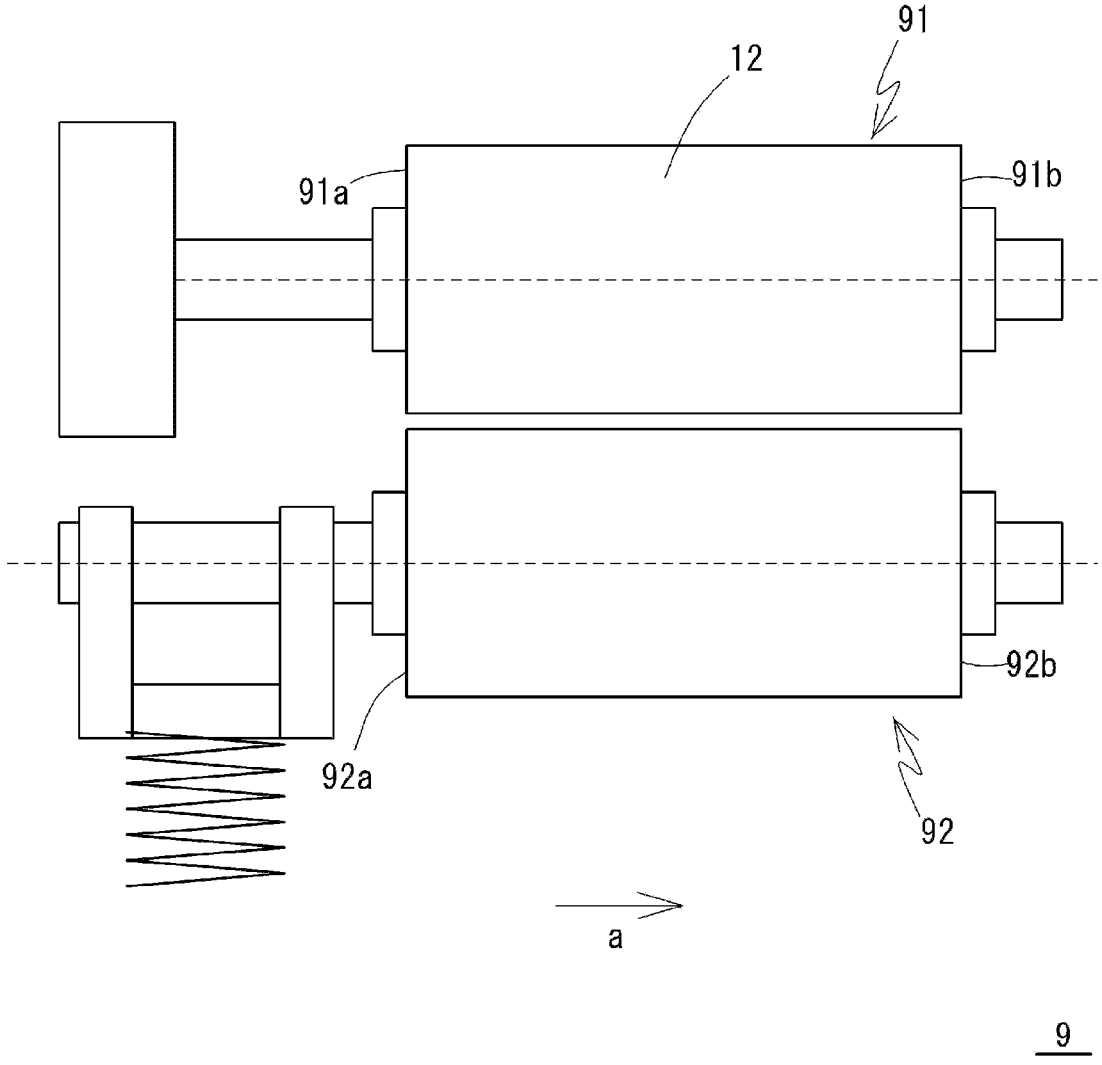

FIG. 6 is a schematic view illustrating a paper feeding device including conventional paper feeding rollers as the feed roller and the retard roller.

Figure 7:
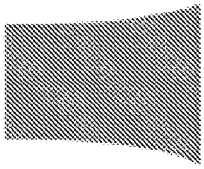
Figure 7:
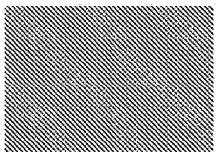
Figure 7:
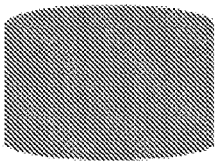
Figure 7:
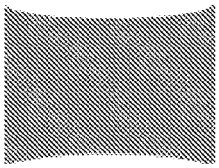

FIG. 7 is a diagram illustrating, as a table, evaluation results of surface pressure distribution and roller durability by varying roller shapes.

Figure 8:
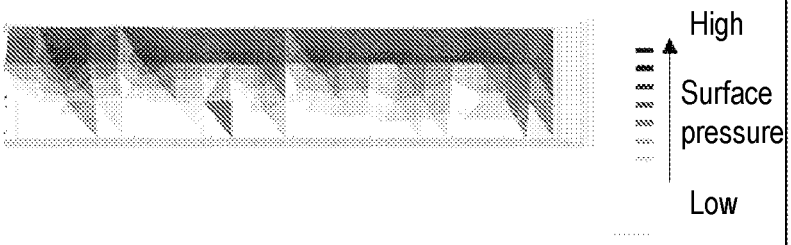
Figure 8:
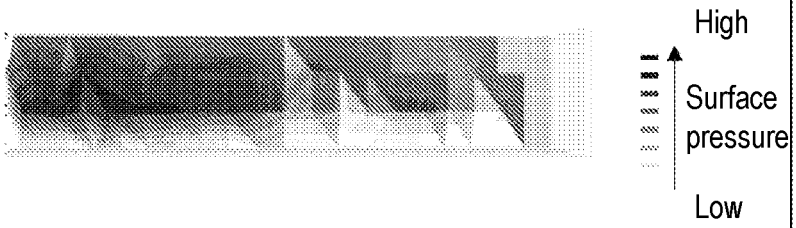

(a) and (b) of FIG. 8 are diagrams illustrating an example of surface pressure distribution measurement results of roller surfaces, where (a) of FIG. 8 illustrates a case of high distribution uniformity, and (b) of FIG. 8 illustrates a case of low distribution uniformity.

DESCRIPTION OF THE EMBODIMENTS

The disclosure provides a paper feeding roller which is not susceptible to paper conveyance failures due to uneven wear, even if the paper feeding roller is used for a long period of time with a cantilever support structure. A paper feeding device including such paper feeding roller is also provided.

In order to solve the above issues, a paper feeding roller according to the disclosure is provided. The paper feeding roller includes: a shaft body; and an elastic body layer formed on an outer circumference of the shaft body. The paper feeding roller is included in a paper feeding device and is a paper feeding roller rotating with a rotation axis as a center. The paper feeding roller has a cantilever support structure in which the shaft body is supported at an end by the paper feeding device. The elastic body layer includes, at two ends along the rotation axis, a supported end as an end at which the shaft body is supported by the paper feeding device, and a free end as an end at which the shaft body is not supported by the paper feeding device. In the elastic body layer, an outer diameter of a cross section orthogonal to the rotation axis is greater at the free end than at the supported end. A widened bottom part in which an outer diameter expands linearly or in an inwardly convex manner along the rotation axis toward the free end is provided in a region including the free end.

Here, it may also be that the widened bottom part is formed by including at least a region from a center position between the supported end and the free end to the free end along the rotation axis. In addition, it may also be that the elastic body layer has a straight cylindrical part continuous with the widened bottom part on a side of the supported end with respect to the widened bottom part along the rotation axis, and an outer diameter change of the straight cylindrical part along the rotation axis is smaller than that of the widened bottom part. It may also be that the outer diameter of the cross section of the elastic body layer orthogonal to the rotation axis is set as D1 at the supported end, set as D2 at a center position between the supported end and the free end along the rotation axis, and set as D3 at the free end, and $|D2-D1| \leq 0.05$ mm, and $0.05 \text{ mm} < D3-D2 \leq 0.50$ mm. It may also be that a JIS-A hardness of a surface of the elastic body layer is 30 degrees or more and 80 degrees or less.

A paper feeding device according to the disclosure includes: a feed roller, which is rotationally driven and conveys paper; and a retard roller, pressed against the feed roller, affixed with a torque limiter, and suppressing double feeding of the paper. At least one of the feed roller and the retard roller is configured as the paper feeding roller according to the disclosure.

Here, it may also be that both of the feed roller and the retard roller are configured as the paper feeding roller according to the disclosure. In addition, it may also be that, in both of the feed roller and the retard roller, a JIS-A hardness of a surface of the elastic body layer is 30 degrees or more and 80 degrees or less. It may also be that, a hardness of a surface of the elastic body layer of the retard roller is greater than a hardness of a surface of the elastic body layer of the feed roller by 5 degrees or more in JIS-A hardness.

The paper feeding roller according to the disclosure has a cantilever support structure, and the elastic body layer has the widened bottom part in a region including the free end not supported by the paper feeding device. In general, in a paper feeding roller adopting a cantilever support structure, when being pressed against another component, a greater surface pressure acts on the cantilevered supported end side than on the free end side, and the surface of the elastic body layer on the side of the cantilevered supported end tends to be worn. However, in the paper feeding roller according to the disclosure, with the widened bottom structure on the side of the free end, when the paper feeding roller receives a surface pressure pressing against each other with another component, the difference in surface pressure between the supported end side and the free end side is hardly large. Therefore, the uneven wear on the supported end side hardly occurs, and even if the paper feeding roller is used for a long time, a paper conveyance failure due to uneven wear hardly occurs.

Here, in the case where the widened bottom part is formed by including at least a region from a center position between the supported end and the free end to the free end along the rotation axis, and in the case where the elastic body layer has a straight cylindrical part continuous with the widened bottom part on a side of the supported end with respect to the widened bottom part along the rotation axis and an outer diameter change of the straight cylindrical part along the rotation axis is smaller than that of the widened bottom part, the concentration of the surface pressure to the side of the supported end can be effectively alleviated.

In the case where the outer diameter of the cross section of the elastic body layer orthogonal to the rotation axis is set as D1 at the supported end, set as D2 at a center position between the supported end and the free end along the rotation axis, and set as D3 at the free end, and $|D2-D1| \leq 0.05$ mm, and $0.05 \text{ mm} < D3-D2 \leq 0.50$ mm, a particularly high effect in terms of the surface pressure uniformity as well as the suppression of uneven wear so caused can be obtained.

In the case where a JIS-A hardness of a surface of the elastic body layer is 30 degrees or more and 80 degrees or less, the wear of the surface of the paper feeding roller can be effectively suppressed, and a damage to the paper such as scraping of the paper is easily avoided.

In the paper feeding device according to the disclosure, at least one of a feed roller and a retard roller pressed against each other is configured as the paper feeding roller according to the disclosure in which the elastic body layer is provided with the widened bottom part at the free end side. Therefore, in the roller having the widened bottom part and the other roller, the uneven wear due to a nonuniform distribution of surface pressure to the supported end side can be suppressed. As a result, it is possible to keep using the paper feeding device for a long time while avoiding a paper conveyance failure due to uneven wear.

Here, in the case where both of the feed roller and the retard roller are configured as the paper feeding roller according to the disclosure, in both of the feed roller and the retard roller, uneven wear can be effectively suppressed, and paper supply can continue for a long time by suppressing paper conveyance failures.

In the case where a JIS-A hardness of a surface of the elastic body layer is 30 degrees or more and 80 degrees or less in both of the feed roller and the retard roller, the wear of the surface can be effectively suppressed, and a damage to the paper such as scraping of the paper is easily avoided in both of the feed roller and the retard roller.

In the case where a hardness of a surface of the elastic body layer of the retard roller is greater than a hardness of a surface of the elastic body layer of the feed roller by 5 degrees or more in JIS-A hardness, the friction coefficient between the retard roller and the feed roller is increased, and a high conveyance performance can be easily achieved in the paper feeding device.

In the following, a paper feeding roller and a paper feeding device according to embodiments of the disclosure will be described in detail. By using the paper feeding roller according to the embodiments of the disclosure, the paper feeding device according to the embodiments of the disclosure can be formed. Although the exact type and purpose of the paper feeding roller according to the embodiments of the disclosure are not particularly limited as long as the paper feeding roller is provided in a paper feeding device, the following mainly focuses on a mode in which a feed roller and a retard roller provided in a paper feeding device of an image forming apparatus are configured as the paper feeding roller according to an embodiment of the disclosure. Firstly, the entire paper feeding device will be schematically described. Then, the details of the paper feeding roller will be described.

[Paper Feeding Device]

Firstly, a paper feeding device according to an embodiment of the disclosure is described.

Figure 2:
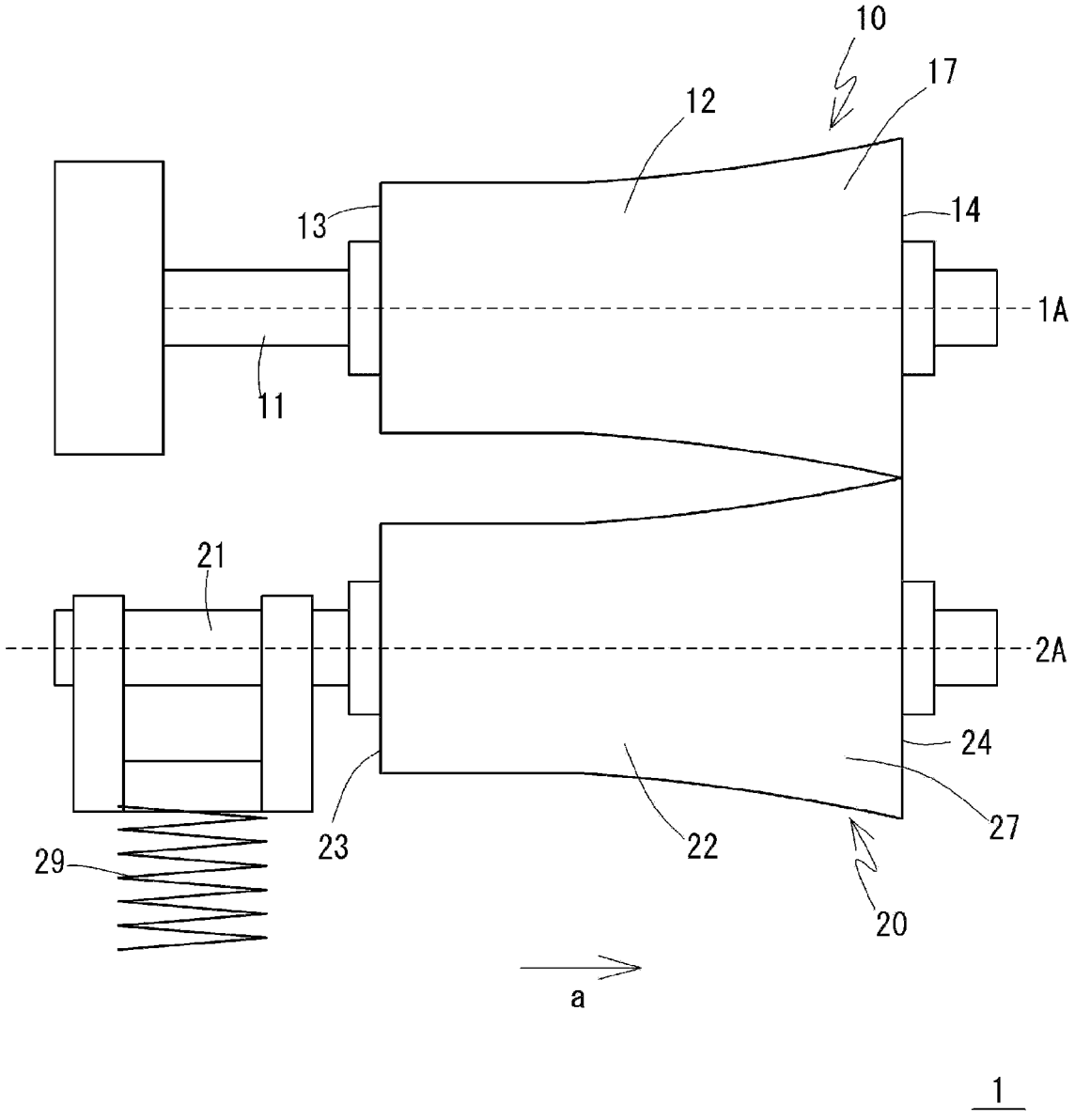
FIG. 2 is a schematic view illustrating a structure in the vicinity of the feed roller and the retard roller in the paper feeding device shown in FIG. 1. A state viewed from the front surface of circumferential surfaces of the feed roller and the retard roller is shown.

A paper feeding device 1 according to an embodiment of the disclosure is included in an electronic photographic image forming apparatus, such as a copier, a printer, a fax machine, etc. As shown in FIGS. 1 and 2, the paper feeding device 1 includes a feed roller 10 (paper feed roller), and a retard roller 20 (separation roller). The feed roller 10 and the retard roller 20 are each formed as a cylindrical member, and are arranged side by side. In the specification, rotation axes 1A and 2A of the feed roller 10 and the retard roller 20 are set as an axial direction (direction a).

The feed roller 10 has a shaft body 11 and an elastic body layer 12 formed on the outer circumference of the shaft body 11. The retard roller 20 has a shaft body 21 and an elastic body layer 22 formed on the outer circumference of the shaft body 21. The feed roller 10 has a function of receiving power from a drive source (motor) not shown herein to be rotationally driven and convey paper P. The retard roller 20 is pressed against the feed roller 10 at a predetermined pressure by using a biasing member 29 formed by a spring, etc. In addition, a torque limiter not shown herein is incorporated in the retard roller 20 and configured to apply a brake torque in a direction opposite to the conveyance direction of the paper P (the direction indicated by an arrow p1). The retard roller 20 has a function of suppressing double feeding of the paper P, that is, suppressing a phenomenon in which multiple papers P are overlapped and supplied.

As shown in FIG. 2, in the paper feeding device 1 according to the embodiment, both of the feed roller 10 and the retard roller 20 has a cantilever support structure, and the shaft bodies 11, 21 are supported by the paper feeding device 1 at an end along the axial direction a. In addition, the elastic body layers 12, 22 have supported ends 13, 23 and free ends 14, 24 at the two ends. The supported ends 13, 23 are ends where the shaft bodies 11, 21 are supported by the paper feeding device 1, and the free ends 14, 24 are ends where the shaft bodies 11, 21 are not supported by the paper feeding device 1. In addition, in the feed roller 10 and the retard roller 20, respectively, the outer diameters are greater at the free ends 14, 24 than the supported ends 13, 23. In addition, the feed roller 10 and the retard roller 20 are provided with widened bottom parts 17, 27 in which the outer diameters widen toward the sides of the free ends 14, 24 along the axial direction a. Regarding the structure of the paper feeding roller according to the embodiment of the disclosure having the widened bottom part on the free end side, details in this regard will be described in subsequent paragraphs. In the paper feeding device 1, the retard roller 20 is pressed against the feed roller 10. However, in FIG. 2, the illustration focuses on the structures of the widened bottom parts 17, 27, and the elastic deformation of the feed roller 10 and the retard roller 20 due to pressure therebetween is not shown.

In the paper feeding device 1, the paper P to be conveyed is piled in a paper feed cassette 30. The surface of a pull-in roller 40 (pickup roller) is in friction contact with the upper surface of the piled paper P. It is configured that, by using the pull-in roller 40, the paper P is rolled out in order from the paper feed cassette 30 toward the feed roller 10. The pull-in roller 40 has a shaft body 41 and an elastic body layer 42 formed on the outer circumference of the shaft body 41. The pull-in roller 40 is configured to rotate in association with the driving of the feed roller 10 by using a linking member (gear, timing belt, etc.) not shown herein.

With the rotational driving of the feed roller 10, the pull-in roller 40 rotates, and the paper P is rolled out one sheet after another from the paper feeding set 30 toward the feed roller 10. As shown in (a) of FIG. 3, the feed roller 10 performs rotational driving before the paper P arrives. Through the rotation of the feed roller 10, the retard roller 20 pressed against the feed roller 10 is driven to rotate against the brake torque through the friction between the feed roller 10 and the retard roller 20 (between the rollers). When the sheet of the paper P that is rolled out arrives between the rollers, as shown in (b) of FIG. 3, the paper P is conveyed through the rollers.

At the time when two sheets of the paper P are rolled out from the paper feeding cassette 30 toward the feed roller 10, as shown in (a) of FIG. 4, before papers P1 and P2 arrive, the feed roller 10 performs rotational driving, and the retard roller 20 is driven through the rotation of the feed roller 10 to rotate against the brake torque. When the two sheets of papers P1 and P2 that are rolled out arrive between the rollers, as shown in (b) of FIG. 4, the retard roller 20 comes into contact with the feed roller 10 via the two sheets of paper P1 and P2. Since the frictional force acting between the two sheets of paper P1 and P2 is small, the retard roller 20 is not driven by the rotation of the feed roller 10 and stops. Accordingly, the paper P1 in contact with the feed roller 10 passes through the rollers through the rotation of the feed roller 10, and the paper P2 in contact with the retard roller 20 is not conveyed. Accordingly, double feeding of the paper P is suppressed.

According to the above, in the paper feeding device 1, both of the feed roller 10 and the retard roller 20 adopt cantilever support structures and have the widened bottom parts 17, 27. However, it is not required that both of the feed roller 10 and the retard roller 20 have the widened bottom parts. It suffices as long as one of the feed roller 10 and the retard roller 20 adopts the cantilever support structure and has the widened bottom part. In the case where only one of the rollers that is cantilevered adopts the widened bottom part, the other roller may adopt a cantilever support structure, and may also adopt a double support structure in which two ends in the axial direction are supported by the paper feeding device 1. In addition, although the shape of the other roller may be set arbitrarily, such roller may have a straight structure whose outer diameter is constant along the axial direction a, like rollers 91, 92 shown in FIG. 6.

(Paper Feeding Roller Having the Widened Bottom Part)

In the following, a paper feeding roller 50 (may be simply referred to as "roller" in the following) having the widened bottom part according to an embodiment of the disclosure will be described in detail. In the paper feeding device 1, the feed roller 10 and the retard roller 20 are respectively configured as the paper feeding roller 50 according to an embodiment of the disclosure.

The paper feeding roller 50 according to an embodiment of the disclosure is used as a component of a paper feeding device, and is formed as a cylindrical member rotating with a rotation axis 5A as the center. As shown in FIG. 5, the paper feeding roller 50 has a shaft body 51 and an elastic body layer 52 formed on the outer circumference of the shaft body 51. In the following, the description relating to the shape of the roller 50 refers to the shape of the elastic body layer 52.

In the roller 50, one end is a supported end 53, and the other end is a free end 54. In the roller 50, on the side of the supported end 53, the shaft body 51 is directly or indirectly supported by the paper feeding device 1. Meanwhile, on the side of the free end 54, the shaft body 51 is maintained in a opened state without being supported by the paper feeding device 1. That is, the roller 50 is provided with a cantilever support structure.

The roller 50 has a cylindrical shape, but is not in a straight cylindrical shape and has a distribution of outer diameters along the axial direction a. That is, although the cross-section orthogonal to the rotation axis 5A is circular at the respective positions along the axial direction a, the outer diameter of the circle is changed in at least a region along the axial direction a.

Specifically, in the roller 50, the cross section orthogonal to the axial direction a is greater at the free end 54 than at the supported end 53. In addition, the roller 50 is provided with a widened bottom part 57 in a region including the free end 54 along the axial direction a. The widened bottom part 57 has a widened bottom shape (diameter expanded shape) in which the outer diameter of the roller 50, that is, the outer diameter of the cross-section orthogonal to the rotation axis 5A, increases along the axial direction a toward the side of the free end 54. More specifically, the widened bottom shape of the widened bottom part 57 is arranged as a tapered shape. That is, the outer diameter of the roller 50 increases linearly or in an inwardly convex manner toward the free end 54. The tapered widened bottom shape can be recognized easily as a contour shape of the circumferential surface in a state viewed from the front surface of the circumferential surface of the roller 50 as shown in FIG. 5, or in a cross section taken along the axial direction a.

In the roller 50, the size of the region occupied by the widened bottom part 57 or the shape of the region other than the widened bottom part 57 is not particularly limited as long as the widened bottom part 57 is formed in a region including the free end 54 along the axial direction a. In the roller 50 as shown in FIG. 5, the widened bottom part 57 is formed only in a region occupying a portion of the side of the free end 54 along the axial direction a, and a straight cylindrical part 56 in a straight shape is formed on the side of the supported end 53. The widened bottom part 57 and the straight cylindrical part 56 are smoothly continuous along the axial direction a.

In FIG. 6, the feed roller 91 and the retard roller 92 of a conventional paper feeding device 9 are shown. The entire conventional paper feeding roller is formed in a straight shape, that is, a straight cylindrical shape. When such paper feeding rollers 91, 92 in the straight shape are cantilevered and receive a contact pressure from a direction of the circumferential surface, a large surface pressure (nip pressure) acts on the side of supported ends 91*a*, 92*a*, and the surface pressure is reduced toward the side of free ends 91*b*, 92*b*. When the rollers 91, 92 rotate in a state of receiving a non-uniform surface pressure, the surfaces on the side of the supported ends 91*a*, 92*a* are severely worn as compared to the side of the free ends 91*b*, 92*b*, and uneven wear occurs. As the wearing of the rollers 91, 92 progresses, the uneven structures on the surfaces of the rollers 91, 92 tend to be worn out or paper dust and dirt tend to be attached easily, and a sufficient friction coefficient is not maintained with the paper P as the conveyance target. Accordingly, with the occurrence of uneven wear, a conveyance failure of the paper P may occur easily.

Meanwhile, as shown in FIG. 5, in the paper feeding roller 50 according to the embodiment, the outer diameter is greater at the free end 54 than at the supported end 53, and the paper feeding roller 50 has the widened bottom part 57 whose outer diameter increases toward the free end 54. Accordingly, even if the paper feeding roller 50 is cantilevered and receives a contact pressure from a direction of the circumferential surface, the contact pressure hardly concentrate on the region of the side of the supported end 53 along a supported axis a. Compared with the case of the straight shape, the surface pressure is spread to the respective portions along the axial direction a, and the uniformity of the surface pressure from the side of the supported end 53 to the free end 54 is facilitated. Therefore, even if the roller 50 is used continuously for a long time, the uneven wear hardly occurs. Accordingly, the initial state of the roller 50 with the uneven structure provided on the surface for increasing the friction coefficient with the paper P, etc., is easily maintained for a long time. As a result, the friction coefficient between the roller 50 and the paper P can be kept high for a long time, and a state in which a conveyance failure of the paper P due to uneven wear hardly occurs can be maintained.

In the paper feeding device 1 described above, at least one of the feed roller 10 and the retard roller 20 is the paper feeding roller 50 of the embodiment having the widened bottom part 57 (17, 27). Even in the case where only one of the feed roller 10 and the retard roller 20 is provided with the widened bottom part 57, since the uniformity of the surface pressure acting between the feed roller 10 and the retard roller 20 is facilitated through the contribution of the widened bottom part 57, the uneven wear can be suppressed on the surfaces of both of the feed roller 10 and the retard roller 20. Nevertheless, if both of the feed roller 10 and the retard roller 20 are configured as the roller 50 of the embodiment provided with the widened bottom part 57 (17, 27), the effect of uneven wear suppression due to facilitated surface pressure uniformity may be further reinforced in both of the feed roller 10 and the retard roller 20. In particular, in the case where both of the feed roller 10 and the retard roller 20 are cantilevered, by configuring both as the roller 50 according to the embodiment provided with the widened bottom part 57 (17, 27), the effect of suppressing the uneven surface pressure distribution and uneven wear due to the cantilever support can be further facilitated.

In the paper feeding roller 50 according to the embodiment, the specific shape of the widened bottom part 57 or the region where the widened bottom part 57 is provided is not particularly limited, as long as the widened bottom part 57 is provided on the side of the free end 54. As described above, the widened bottom shape of the widened bottom part 57, in the axial direction a toward the free end 54, may be a shape in which the diameter expands linearly or a shape in which the diameter expands in an inwardly convex manner. However, from the perspective of facilitating the effect of uniforming the surface pressure by using the widened bottom shape, the widened bottom part 57 with an inwardly convex shape may be adopted. The inwardly convex shape refers to a shape that is convex toward the inner side of the paper feeding roller 50 in a smooth curve, and does not include a mode having a stepped, discontinuous outer diameter change in the middle of the widened bottom part 57 or a mode including, in a portion, a region in which the outer diameter does not change or changes in a outwardly convex manner.

It is found that, at a position close to the free end 54, the effect of uniforming the surface pressure by providing the widened bottom part 57 in the roller 50 is greater as the outer diameter of the roller 50 increases. From the perspective of providing a large outer diameter change in the widened bottom part 57 and making it easier to uniform the surface pressure, as in the mode shown in FIG. 5, the widened bottom part 57 may be formed by including at least a region from a center part 55 at a center position between the supported end 53 and the free end 54 to the free end 54. Meanwhile, even if the widened bottom part 57 extends to the side of the supported end 53 of the roller 50 and is excessively provided, the increase in the effect of uniforming the surface pressure is saturated, and it is also possible that the effect of spreading the surface pressure acting on the side of the supported end 53 may decrease. From the perspective of preventing the effect of spreading the surface pressure from being saturated or decreasing, the widened bottom part 57 may be limited to a region from the position of the center part 55, or from a position on the side of the free end 54 with respect to the center part 55, to the free end 54. The region in which the widened bottom part 57 is provided along the axial direction a may be selected in accordance with the required degree of uniforming the surface pressure or the specific dimension, material, etc., of the roller 55. From the perspective of preventing the effect of spreading the surface pressure from being saturated or decreasing, as in the mode shown in FIG. 5, the roller 50 may be configured in a state in which, along the axial direction a, the widened bottom part 57 is provided in a region on the side of the free end 54, the straight cylindrical part 56 is provided on the side of the supported end 53, and the widened bottom part 57 and the straight cylindrical part 56 are smoothly connected. Here, the straight cylindrical part 56 is not limited to being in a completely straight cylindrical shape, but suffices as long as the outer diameter change thereof along the axial direction a is smaller than that of the widened bottom part 57. In the case where the widened bottom part 57 and the cylindrical part 56 are provided together in the roller 50, it suffices as long as the widened bottom part 57 is provided in a region on the side of the free end 54, and a region on the side of the supported end 53 with respect to the widened bottom part 57 is arranged as the straight cylindrical part 56. It may also be that the region on the side of the supported end 53 with respect to the widened bottom part 57 does not expand toward the side of the supported end 53 as in a reverse crown shape (see FIG. 7).

The extent to which the outer diameter of the roller 50 changes in the widened bottom part 57 is not particularly limited. However, the following modes can be provided as examples. Here, the outer diameter of the cross section of the roller 50 orthogonal to the axial direction a is arranged as D1 at the supported end 53, D2 at the center part 55, and D3 at the free end 54.

Firstly, a difference (D3−D2) between the outer diameter D3 of the free end 54 and the outer diameter D2 of the center part is described. In the case where $L1<D3-D2$, a lower limit L1 may be 0.05 mm. This means that the extent to which the outer diameter changes in the widened bottom part 57 is sufficiently large, and, by providing the widened bottom part 57 on the side of the free end 54, the localization of the surface pressure toward the side of the supported end 53 can be effectively alleviated. The lower limit L1 may also be set as 0.075 mm or 0.10 mm.

Meanwhile, in the case where $D3-D2\leq L2$, an upper limit L2 may be 0.50 mm. By doing so, the situation in which the surface pressure on the side of the free end 54 exceeds that on the side of the supported end 53 due to an excessive change in the outer diameter at the widened bottom part 57 is easily avoided. The upper limit L2 may also be set as 0.40 mm or 0.30 mm.

In addition, an absolute value ($|D2-D1|$) of the difference between the outer diameter D2 of the center part and the outer diameter D1 of the supported end 53 is described. In the case where $(|D2-D1|)\leq L3$, an upper limit L3 of the absolute value may be 0.05 mm. This means that, at the portion on the side of the supported end 53 of the roller 50, the change in the outer diameter along the axial direction a is suppressed, and the region on the side of the supported end 53 of the roller 50 is arranged as the straight cylindrical part 56 in the straight shape or a similar shape. By doing so, the roller 50 reduces the surface pressure acting in the region on the side of the supported end 53, and the effect of uniforming the surface pressure is excellent. The upper limit L3 may also be set as 0.04 mm or 0.03 mm. The smaller the difference between D2 and D1, the greater the contribution to the surface pressure uniformity, so no specific lower limit is set for the value of $|D2-D1|$. A mode in which D2=D1, that is, the straight cylindrical part 56 is in a straight cylindrical shape, may be favorable.

In the roller 50 of the embodiment, the hardness of the surface, that is, the hardness of the outer circumferential surface of the elastic body layer 52, may be equal to or greater than 30 degrees or more in JIS-A hardness. In addition, a JIS-A hardness of 40 degrees or more or 50 degrees or more may also be adopted. By doing so, the surface wear of the roller 50 is easily suppressed. Meanwhile, the hardness of the surface of the roller 50 may be 80 degrees or less in JIS-A hardness. In addition, a JIS-A hardness of 70 degrees or less or 65 degrees or less may also be adopted. By doing so, damage to the paper P, such as scraping of the paper, due to contact with the roller 50 is easily suppressed, and the image quality does not deteriorate. The hardness of the roller 50 can be adjusted in accordance with the material configuration of the elastic body layer 52, the thickness of the elastic body layer 52, etc.

In the paper feeding device 1, in both of the case where only one of the feed roller 10 and the retard roller 20 is configured as the roller 50 of the embodiment provided with the widened bottom part 57 and the case where both of the feed roller 10 and the retard roller 20 are configured as the roller 50, the feed roller 10 and the retard roller 20 may exhibit hardnesses in the above range. In addition, there may be a difference between the hardness of the surface of the feed roller 10 and the hardness of the surface of the retard roller 20. When there is a difference between the hardness of the surface of the feed roller 10 and the hardness of the surface of the retard roller 20, with the surface of one of the rollers bites into the surface of the other roller, the friction coefficient between the feed roller 10 and the retard roller 20 is easily increased. Accordingly, the performance of conveying the paper P (the pushing force in a conveyance direction p1 of the paper P) is facilitated. The hardness of the surface of the retard roller 20 may be higher than the hardness of the surface of the feed roller 10. From the perspective of increasing the effect of facilitating the conveyance performance, the difference in surface hardness may be 5 degrees or more, 10 degrees or more, or 15 degrees or more in JIS-A hardness. Meanwhile, from the perspective of the ease of suppressing the wear of the feed roller 10 and the retard roller 20, the difference in hardness may be 50 degrees or less or 40 degrees or less in JIS-A hardness.

Although the material for forming the roller 50 according to the embodiment is not particularly limited, as an example, the elastic body layer 52 may be formed by an elastic body containing polyurethane. By containing polyurethane, the elastic body layer 52 exhibits excellent wear resistance when used for a long time. The elastic body layer 52 may also include a conductive agent or various additives. The thickness of the elastic body layer 52 is not particularly limited, as long as it is set as appropriate within a range of 0.1 mm to 10 mm. The elastic body layer 52 may exhibit surface unevenness on the outer circumferential surface. With the surface unevenness, the friction coefficient of the surface can be increased. With the roller 50 provided with the widened bottom part 57, the wear out of the surface unevenness due to uneven wear and the decrease in friction coefficient so caused hardly occur, and the state that the friction coefficient is high because of the surface unevenness is maintained for a long time.

The elastic body layer 52 of the roller 50 can be formed through molding, etc., by using a molding die. For example, the shaft body is coaxially arranged with a hollow part of a roller molding die, and an uncrosslinked urethane composition is injected and heated/cured (crosslinked). Then, by removing the molding die, the elastic body layer 52 can be formed on the outer circumference of the shaft body. By using a molding die having a shape corresponding to the widened bottom part 57 on the inner circumferential surface, the widened bottom part 57 can be formed in the roller 50. In addition, by arranging an uneven shape on the inner circumferential surface of the molding die, unevenness can also be arranged on the surface of the elastic body layer 52.

EXAMPLES

In the following, examples and comparative examples are used to describe the disclosure in detail. Here, feed rollers and retard rollers having various shapes were manufactured, and surface pressure distribution and durability were evaluated.

[Manufacture of Samples]

Items of multiple shapes were manufactured as the feed rollers and the retard rollers. As shown in FIG. 7, the shapes of the feed rollers and the retard rollers were arranged as a widened bottom shape, a straight shape, a crown shape, and a reverse crown shape. Regarding the rollers of the widened bottom shape, multiple rollers with different outer diameters D1, D2, D3 of the supported end, the central end, and the free end were prepared.

At the time of manufacturing the feed rollers and the retard rollers, in a through hole of a die in each of the predetermined shapes and having an uneven structure on the inner circumferential surface, a metal core (outer diameter φ 10 mm) was coaxially set, the opening parts at the two ends were closed with caps, and an uncrosslinked thermosetting urethane polymer as the forming material of the elastic body layer was filled into the molding space thereof. Then the molding die thereof was put into an oven and crosslinked (150° C.×60 min.). In addition, the elastic body consisting of the crosslinked thermosetting urethane polymer was formed on the outer circumferential surface of the metal core. Then, the die was removed, and the elastic body was removed from the metal core and cut in a length of 25 mm. The obtained elastic body was in a tube shape (the outer diameter was as indicated in Tables 1 and 2, inner diameter φ: 10 mm, and length: 25 mm), and the surface of the elastic body was formed to be uneven. Then, a shaft body (length: 27 mm; outer diameter φ: 10 mm) made of polyacetal (POM) was prepared. Then, the shaft body was pressed into the hollow part of the tube-shaped elastic body. According to the above, the feed rollers and the retard rollers were each manufactured. The surface hardnesses of the feed rollers and the retard rollers were adjusted by the amounts of plasticizer added to the urethane polymer.

Evaluation Method (1) Evaluation of Surface Pressure Distribution

A distribution of surface pressures acting between the feed roller and the retard roller is measured in a state in which the feed roller and the retard roller manufactured according to the above are cantilevered and assembled to a commercially available copier having a FRR paper feeding system. The surface pressure distribution is evaluated by measuring an acting surface pressure in each square with an area of 1 $mm^2$, with a pressure sensor sheet as a surface pressure measurement device being sandwiched between the feed rollers and the retard rollers. The pressure sensor sheet is a pressure sensor sheet in which column and row electrodes are arrayed and crossed inside a sheet with a thickness of about 1 mm, and in which an electrical resistance varies when a pressure is applied to the sheet. The tendency change amount of the electrical resistance is converted into a pressure value to be output.

For an obtained surface pressure distribution, among all the measurement data, a ratio is calculated by dividing, by a load, a difference between the maximum surface pressure and the minimum surface pressure in the data of a column in the axial direction including the maximum surface pressure. A ratio 3% or less is evaluated as "A", a ratio greater than 3% and 6% or less is evaluated as "B", a ratio greater than 6% and 10% or less is evaluated as "C", a ratio greater than 10% and 15% or less is evaluated as "D", and a ratio more than 15% is evaluated as "E". If the evaluation result is A, B, or C, a determination that the surface pressure distribution uniformity is sufficiently high can be made. If the evaluation result is D or E, a determination that the surface pressure distribution is not uniform is made.

FIG. 8 illustrates an example in which surface pressures are evaluated by using the above method. In the figure, surface pressure distributions that are measured are expressed in a gray scale in which the higher the surface pressure, the darker the color. The horizontal direction of the figure indicates the axial direction of the roller, and the entire region of the roller is shown. In (a) of FIG. 8, it can be seen that although a surface pressure distribution can be seen in the vertical direction of the figure, no significant nonuniform surface pressure distribution is observed, and, along the axial direction of the roller, the surface pressure is acting with high uniformity. Correspondingly, the evaluation on the surface pressure distribution uniformity is high as "A". Meanwhile, in (b) of FIG. 8, a significant nonuniform surface pressure distribution occurs along the horizontal direction of the figure. Specifically, it is observed that, on the left side (supported end side) of the figure, the surface pressure is greater than that of the right side (free end side). In particular, the nonuniformity of the surface pressure along the horizontal direction is increased in a region extending from the middle toward the bottom in the vertical direction. Accordingly, in (b) of FIG. 8, the surface pressure acting on the roller is nonuniform along the axial direction. Correspondingly, the evaluation on the surface pressure distribution uniformity is low as "D".

(2) Evaluation of Durability

The feed rollers and the retard rollers manufactured according to the above were cantilevered and assembled to a commercially available copier having an FRR paper feeding system, and the paper feeding performance was evaluated. Commercially available PPR paper was used as the paper, and 0.5 million sheets of paper were fed to measure the number of paper jams. Those with zero paper jams were rated as "A", those with 1 or more and 3 or fewer paper jams were rated as "B", those with 4 or more and 6 or fewer paper jams were rated as "C", those with 7 or more and 10 or fewer paper jams were rated as "D", and those with 11 or more paper jams of 11 were rated as "E". If the evaluation result is A, B, or C, a determination that the durability is sufficiently high can be made. If the evaluation result is D or E, the durability is determined as low.

[Evaluation Results]

In FIG. 7, as the modes using the paper feeding rollers of various shapes, the roller shapes (feed roller and retard roller are the same) and the evaluation results of surface pressure distribution and durability for Example 20 and Comparative Examples 1 to 3 are shown. In the figures of shapes, the left side of the figure indicates the supported end, and the right side of the figure indicates the free end. Regardless of the shape, the JIS-A hardness of the surface is 60 degrees for the feed roller and 70 degrees for the retard roller. In addition, Tables 1 and 2 summarize the shapes, the outer diameters D1, D2, and D3 and the relationships thereof, and the surface hardnesses of the respective rollers as well as the evaluation results of surface pressure distribution and durability for all the examples and the comparative examples.

TABLE 1

| | | Example | | | | | | | | | |
|---|---|---|---|---|---|---|---|---|---|---|---|
| | | 1 | 2 | 3 | 4 | 5 | 6 | 7 | 8 | 9 | 10 |
| Feed roller structure | Shape | Straight | Widened bottom | | | | | Straight | | | |
| | D1 (mm) | 20.00 | 20.05 | 20.00 | 20.00 | 20.00 | 20.00 | 20.00 | 20.00 | 20.00 | 20.00 |
| | D2 (mm) | 20.00 | 20.00 | 20.05 | 20.00 | 20.00 | 20.00 | 20.00 | 20.00 | 20.00 | 20.00 |
| | D3 (mm) | 20.00 | 20.25 | 20.25 | 20.05 | 20.50 | 20.00 | 20.00 | 20.00 | 20.00 | 20.00 |
| | \|D2 − D1\|(mm) | 0.00 | 0.05 | 0.05 | 0.00 | 0.00 | 0.00 | 0.00 | 0.00 | 0.00 | 0.00 |
| | D3 − D2 (mm) | 0.00 | 0.20 | 0.20 | 0.00 | 0.50 | 0.00 | 0.00 | 0.00 | 0.00 | 0.00 |
| Retard roller structure | Shape | Widened bottom | Straight | | | | | Widened bottom | | | |
| | D1 (mm) | 20.00 | 20.00 | 20.00 | 20.00 | 20.00 | 20.05 | 20.00 | 20.00 | 20.00 | 20.08 |
| | D2 (mm) | 20.00 | 20.00 | 20.00 | 20.00 | 20.00 | 20.00 | 20.00 | 20.00 | 20.00 | 20.00 |
| | D3 (mm) | 20.25 | 20.00 | 30.00 | 20.00 | 20.00 | 20.25 | 20.25 | 20.0 | 20.25 | 20.25 |
| | \|D2 − D1\| (mm) | 0.00 | 0.00 | 0.00 | 0.00 | 0.00 | 0.05 | 0.05 | 0.00 | 0.00 | 0.08 |
| | D3 − D2 (mm) | 0.25 | 0.00 | 0.00 | 0.00 | 0.00 | 0.25 | 0.20 | 0.05 | 0.50 | 0.25 |
| Surface hardness (JIS-A) | Feeder roller | 60 | 60 | 60 | 60 | 60 | 60 | 60 | 60 | 60 | 60 |
| | Retard roller | 70 | 70 | 70 | 70 | 70 | 70 | 70 | 70 | 70 | 70 |
| | Hardness diff. | 10 | 10 | 10 | 10 | 10 | 10 | 10 | 10 | 10 | 10 |
| Evaulation Result | Surface pressure distribution | A | B | B | B | B | B | B | B | B | C |
| | Durability | A | B | B | B | B | B | B | B | B | C |

TABLE 1-continued

| | | Example | | | | | | | | |
|---|---|---|---|---|---|---|---|---|---|---|
| | | 11 | 12 | 13 | 14 | 15 | 16 | 17 | 18 | 19 |
| Feed roller structure | Shape | Straight | | | | | | | | |
| | D1 (mm) | 20.00 | 20.00 | 20.00 | 20.00 | 20.00 | 20.00 | 20.00 | 20.00 | 20.00 |
| | D2 (mm) | 20.00 | 20.00 | 20.00 | 20.00 | 20.00 | 20.00 | 20.00 | 20.00 | 20.00 |
| | D3 (mm) | 20.00 | 20.00 | 20.00 | 20.00 | 20.00 | 20.00 | 20.00 | 20.00 | 20.00 |
| | \|D2 − D1\| (mm) | 0.00 | 0.00 | 0.00 | 0.00 | 0.00 | 0.00 | 0.00 | 0.00 | 0.00 |
| | D3 − D2 (mm) | 0.00 | 0.00 | 0.00 | 0.00 | 0.00 | 0.00 | 0.00 | 0.00 | 0.00 |
| Retard roller structure | Shape | Widened bottom | | | | | | | | |
| | D1 (mm) | 20.00 | 20.00 | 20.00 | 20.00 | 20.00 | 20.00 | 20.00 | 20.00 | 20.00 |
| | D2 (mm) | 20.00 | 20.00 | 20.00 | 20.00 | 20.00 | 20.00 | 20.00 | 20.00 | 20.00 |
| | D3 (mm) | 20.00 | 20.03 | 20.25 | 20.25 | 20.25 | 20.25 | 20.25 | 20.25 | 20.25 |
| | \|D2 − D1\| (mm) | 0.00 | 0.03 | 0.00 | 0.00 | 0.00 | 0.00 | 0.00 | 0.00 | 0.00 |
| | D3 − D2 (mm) | 0.03 | 0.06 | 0.25 | 0.25 | 0.25 | 0.25 | 0.25 | 0.25 | 0.25 |
| Surface hardness (JIS-A) | Feeder roller | 60 | 60 | 30 | 80 | 60 | 60 | 65 | 50 | 60 |
| | Retard roller | 70 | 70 | 70 | 70 | 30 | 80 | 70 | 55 | 60 |
| | Hardness diff. | 10 | 10 | 40 | −10 | −30 | 20 | 5 | −5 | 0 |
| Evaulation Result | Surface pressure distribution | C | C | A | A | A | A | B | B | B |
| | Durability | C | C | A | C | C | A | A | C | C |

TABLE 2

| | | Example | | | | | | | | | | | Comparative Example | | |
|---|---|---|---|---|---|---|---|---|---|---|---|---|---|---|---|
| | | 20 | 21 | 22 | 23 | 24 | 25 | 26 | 27 | 28 | 29 | 30 | 1 | 2 | 3 |
| Feed roller structure | Shape | Widened bottom | | | | | | | | Straight | | | Straight | Crown | Reverse crown |
| | D1 (mm) | 20.00 | 20.05 | 20 | 20 | 20.00 | 20.00 | 20.00 | 20.00 | 15.00 | 30.00 | 50.00 | 20.00 | 20.00 | 20.25 |
| | D2 (mm) | 20.00 | 20.00 | 20 | 20 | 20.00 | 20.00 | 20.00 | 20.00 | 15.00 | 30.00 | 50.00 | 20.00 | 20.00 | 20.00 |
| | D3 (mm) | 20.25 | 20.25 | 20.05 | 20.50 | 20.25 | 20.25 | 20.25 | 20.25 | 15.00 | 30.00 | 50.00 | 20.00 | 20.00 | 20.25 |
| | \|D2 − D1\| (mm) | 0.00 | 0.05 | 0.00 | 0.00 | 0.00 | 0.00 | 0.00 | 0.00 | 0.00 | 0.00 | 0.00 | 0.00 | 0.20 | 0.25 |
| | D3 − D2 (mm) | 0.25 | 0.25 | 0.05 | 0.5 | 0.25 | 0.25 | 0.25 | 0.25 | 0.00 | 0.00 | 0.00 | 0.00 | −0.20 | 0.25 |
| Retard roller structure | Shape | Widened bottom | | | | | | | | Widened bottom | | | Straight | Crown | Reverse crown |
| | D1 (mm) | 20.00 | 20.05 | 20.00 | 20.00 | 20.00 | 20.00 | 20.00 | 20.00 | 15.00 | 30.00 | 50.00 | 20.00 | 20.00 | 20.25 |
| | D2 (mm) | 20.00 | 20.00 | 20.00 | 20.00 | 20.00 | 20.00 | 20.00 | 20.00 | 15.00 | 30.00 | 50.00 | 20.00 | 20.20 | 20.00 |
| | D3 (mm) | 20.25 | 20.25 | 20.05 | 20.50 | 20.25 | 20.25 | 20.25 | 20.25 | 15.25 | 30.25 | 50.25 | 20.00 | 20.00 | 20.25 |
| | \|D2 − D1\| (mm) | 0.00 | 0.05 | 0.00 | 0.00 | 0.00 | 0.00 | 0.00 | 0.00 | 0.00 | 0.00 | 0.00 | 0.00 | 0.20 | 0.25 |
| | D3 − D2 (mm) | 0.25 | 0.25 | 0.5 | 0.5 | 0.25 | 0.25 | 0.25 | 0.25 | 0.25 | 0.25 | 0.25 | 0.00 | −0.20 | 0.25 |
| Surface hardness (JIS-A) | Feeder roller | 60 | 60 | 60 | 60 | 30 | 80 | 70 | 70 | 60 | 60 | 60 | 50 | 60 | 60 |
| | Retard roller | 70 | 70 | 70 | 70 | 60 | 60 | 30 | 80 | 70 | 70 | 70 | 70 | 70 | 70 |
| | Hardness diff. | 10 | 10 | 10 | 10 | 30 | −20 | −40 | 10 | 10 | 10 | 10 | 10 | 10 | 10 |
| Evaulation Result | Surface pressure distribution | A | B | B | C | A | A | A | A | A | A | A | D | E | E |
| | Durability | A | B | B | B | A | C | C | A | A | A | A | D | E | E |

As shown in FIG. 7, in the case of Comparative Example 1 in which the feed roller and the retard roller were in the conventional straight shapes, the surface pressure exhibited a nonuniform distribution (rated as D). As the pattern of the surface pressure distribution, the pressure was low at the side of the free end and high at the side of the supported end, and the surface pressure was unevenly distributed on the supported end side. Comparatively, in the case of Example 20 in which the feed roller and the retard roller were in the widened bottom shapes, the surface pressure distribution uniformity was higher (rated as A). As the pattern of the surface pressure distribution, the unevenness of the surface pressure distribution on the side of the supported end alleviated, and the surface pressure was reduced gradually from the supported end side toward the free end side. Compared with the case of the straight shape, the surface pressure distribution uniformity along the axial direction increased. Corresponding to the increased surface pressure distribution uniformity, the evaluation result of durability indicates that the case of the straight shape of Comparative Example 1 was rated low as "D", while the case of the widened bottom shape of Example 20 was rated high as "A". Accordingly, by forming the widened bottom part on the free end side of the cantilevered paper feeding roller, it is known that the surface pressure was spread and the surface pressure distribution uniformity can be increased with respect to the case of the conventional paper feeding roller which is entirely in a straight shape. As a result, the durability of the paper feeding roller is increased. It is considered that the increase in durability results from suppression of uneven wear.

In the case of the crown shape of Comparative Example 2 and the case of the reverse crown shape of Comparative Example 3, the surface pressure distribution uniformities were even lower (rated as "E") than the case of the straight shape. As the pattern of the surface pressure distribution, in the case of the crown shape of Comparative Example 2, compared with the case of the straight shape of Comparative Example 1, the place of the uneven distribution of the surface pressure was moved toward the side of the center portion of the axial direction. In the case of the reverse crown shape of Comparative Example 3, a complicated surface pressure distribution was exhibited in that, along the axial direction, the surface pressure decreased from the supported end side toward the vicinity of the center part, whereas the surface pressure increased from a position in the vicinity of the central part further toward the side of the free end. However, in both cases, the nonuniformity of the surface pressure distribution was in general more significant than the case of the straight shape. Correspondingly, in both cases of Comparative Examples 2 and 3, the evaluation of durability was low as "E". Accordingly, it can be said that, even if the paper feeding roller is formed in a crown shape or a reverse crown shape, differing from the case where the paper feeding roller is formed in a widened bottom shape, the effect of uniforming the surface pressure distribution and increasing the durability cannot be achieved, and the durability is further reduced.

Moreover, in the respective examples summarized in Tables 1 and 2, the evaluation results of surface pressure distribution and durability are shown for the cases where the shapes of the feed roller and the retard roller are combined and the outer diameters (D1, D2, D3) of the respective parts and the hardnesses are varied. In all of the examples, at least one of the feed roller and the retard roller was provided with a widened bottom shape. In addition, in all of the examples, ratings of C or higher in terms of surface pressure distribution uniformity and durability were obtained.

Firstly, as the combinations of the shapes of feed rollers and retard rollers, in Examples 1, 6 to 19, and 28 to 30, only the retard rollers were in the widened bottom shape, and the feed rollers were in the straight shape. Comparatively in Examples 2 to 5, only the feed rollers were in the widened bottom shape, and the retard rollers were in the straight shape. In Examples 20 to 27, both of the feed rollers and the retard rollers were in the widened bottom shape. For the three combinations, when the cases where the outer diameters (D1, D2, D3) of the respective parts of the rollers adopting the widened bottom shape were the same and the hardnesses of the two rollers were the same were compared with each other (e.g., when Examples 2, 6, 21 were compared with each other), substantially the same evaluation results were obtained in terms of surface pressure distribution and durability. Accordingly, it can be said that if at least one of the feed roller and the retard roller is in the widened bottom shape, higher surface pressure uniformity and durability can be obtained regardless of which of the feed roller and the retard roller is in the widened bottom shape.

In each of the group of Examples 1 and 6 to 12, the group of Examples 2 to 5, and the group of Examples 20 to 23, the values of the outer diameter differences D3−D2 and |D2−D1| of the rollers having the widened bottom shape were different from each other. By comparing the evaluation results in these groups, there is a tendency that high surface pressure uniformity and durability were obtained in Examples 1 to 9 and 20 to 23 in which $|D2-D1| \leq 0.05$ mm, and $0.05 \text{ mm} < D3-D2 \leq 0.50$ mm. In particular, in Examples 1 and 20 in which $|D2-D1| \leq 0.00$ mm, that is, D1=D2, and $D3-D2 \leq 0.40$ mm, excellent surface pressure uniformity and durability rated as "A" were obtained.

Although in Examples 28 to 30, the absolute values of the outer diameters (D1, D2, D3) were respectively different from Example 1, the values of the diameter differences |D2−D1| and D3−D1 were the same. In all of Examples 28 to 30, the ratings of "A" same as Example 1 were obtained in terms of surface pressure uniformity and durability. From the result, it can be said that if at least one of the feed roller and the retard roller is arranged in a widened bottom shape, and the roller with the widened bottom shape is designed to satisfy $|D2-D1| \leq 0.05$ mm, and $0.05 \text{ mm} < D3-D2 \leq 0.50$ mm, regardless of the absolute values of the outer diameters of the respective rollers, high surface pressure distribution uniformity and durability can be obtained.

In the group of Examples 1 and 13 to 19 and the group of Examples 20 and 24 to 27, the surface hardnesses of the feed rollers and/or the retard rollers were different from each other. In all of these examples, the hardnesses of the feed rollers and the retard rollers were within the range of 30 degrees or more and 80 degrees or less in JIS-A hardness, and these examples obtained the ratings as "C" or higher indicating high surface pressure uniformity distribution and durability. Among these examples, in Examples 1, 13, 16, 17, 20, 24, and 27 in which the retard roller was harder than the feed roller and the difference was equal to or greater than 5 degrees in JIS-A hardness, high surface pressure uniformity with the rating "B" or higher and excellent durability of "A" were obtained.

Although the embodiments and examples of the disclosure have been described above, the disclosure is by no means limited to the above embodiments and examples, and various modifications are possible without departing from the scope of the disclosure.

What is claimed is:

1. A paper feeding roller, comprising:

a shaft body; and an elastic body layer formed on an outer circumference of the shaft body, wherein the paper feeding roller is comprised in a paper feeding device and is a paper feeding roller rotating with a rotation axis as a center, the paper feeding roller has a cantilever support structure in which the shaft body is supported at an end by the paper feeding device, the elastic body layer comprises, at two ends along the rotation axis, a supported end as an end at which the shaft body is supported by the paper feeding device, and a free end as an end at which the shaft body is not supported by the paper feeding device, in the elastic body layer, an outer diameter of a cross section orthogonal to the rotation axis is greater at the free end than at the supported end, and a widened bottom part in which an outer diameter expands linearly or in an inwardly convex manner along the rotation axis toward the free end is provided in a region comprising the free end, wherein the widened bottom part is formed by comprising at least a region from a center position between the supported end and the free end to the free end along the rotation axis, wherein the elastic body layer has a straight cylindrical part continuous with the widened bottom part on a side of the supported end with respect to the widened bottom part along the rotation axis, wherein an outer diameter change of the straight cylindrical part along the rotation axis is smaller than that of the widened bottom part.

2. The paper feeding roller as claimed in claim 1, wherein the outer diameter of the cross section of the elastic body layer orthogonal to the rotation axis is set as D1 at the supported end, set as D2 at a center position between the supported end and the free end along the rotation axis, and set as D3 at the free end, wherein $|D2-D1| \leq 0.05$ mm, and $0.05 \text{ mm} < D3-D2 \leq 0.50$ mm.

3. The paper feeding roller as claimed in claim 2, wherein a JIS-A hardness of a surface of the elastic body layer is 30 degrees or more and 80 degrees or less.

4. The paper feeding roller as claimed in claim 1, wherein a JIS-A hardness of a surface of the elastic body layer is 30 degrees or more and 80 degrees or less.

5. A paper feeding device, comprising:

a feed roller, which is rotationally driven and conveys paper; and a retard roller, pressed against the feed roller, affixed with a torque limiter, and suppressing double feeding of the paper, wherein at least one of the feed roller and the retard roller is configured as the paper feeding roller as claimed in claim 1.

6. The paper feeding device as claimed in claim 5, wherein both of the feed roller and the retard roller are configured as the paper feeding roller.

7. The paper feeding device as claimed in claim 6, wherein in both of the feed roller and the retard roller, a JIS-A hardness of a surface of the elastic body layer is 30 degrees or more and 80 degrees or less.

8. The paper feeding device as claimed in claim 6, wherein a hardness of a surface of the elastic body layer of the retard roller is greater than a hardness of a surface of the elastic body layer of the feed roller by 5 degrees or more in JIS-A hardness.

9. The paper feeding device as claimed in claim 5, wherein in both of the feed roller and the retard roller, a JIS-A hardness of a surface of the elastic body layer is 30 degrees or more and 80 degrees or less.

10. The paper feeding device as claimed in claim 9, wherein the hardness of the surface of the elastic body layer of the retard roller is greater than the hardness of the surface of the elastic body layer of the feed roller by 5 degrees or more in JIS-A hardness.

11. The paper feeding device as claimed in claim 5, wherein a hardness of a surface of the elastic body layer of the retard roller is greater than a hardness of a surface of the elastic body layer of the feed roller by 5 degrees or more in JIS-A hardness.

12. A paper feeding device, comprising:

a feed roller, which is rotationally driven and conveys paper; and a retard roller, pressed against the feed roller, affixed with a torque limiter, and suppressing double feeding of the paper, wherein at least one of the feed roller and the retard roller is configured as a paper feeding roller comprising:

a shaft body; and an elastic body layer formed on an outer circumference of the shaft body, wherein the paper feeding roller is a paper feeding roller rotating with a rotation axis as a center, the paper feeding roller has a cantilever support structure in which the shaft body is supported at an end by the paper feeding device, the elastic body layer comprises, at two ends along the rotation axis, a supported end as an end at which the shaft body is supported by the paper feeding device, and a free end as an end at which the shaft body is not supported by the paper feeding device, in the elastic body layer, an outer diameter of a cross section orthogonal to the rotation axis is greater at the free end than at the supported end, and a widened bottom part in which an outer diameter expands linearly or in an inwardly convex manner along the rotation axis toward the free end is provided in a region comprising the free end, wherein a hardness of a surface of the elastic body layer of the retard roller is greater than a hardness of a surface of the elastic body layer of the feed roller by 5 degrees or more in JIS-A hardness.

* * * * *